United States Patent [19]

Grebe et al.

[11] Patent Number: 4,623,096

[45] Date of Patent: Nov. 18, 1986

[54] PROCESS AND EQUIPMENT FOR CUTTING MATERIAL

[75] Inventors: Reiner Grebe, Biedenkopf; Max Norbisrath; Karl-Heinz Schmidt, both of Briedenbach, all of Fed. Rep. of Germany

[73] Assignee: Kramer & Grebe GmbH & Co. KG, Biedenkopf-Wallau, Fed. Rep. of Germany

[21] Appl. No.: 673,225

[22] Filed: Nov. 20, 1984

Related U.S. Application Data

[63] Continuation of Ser. No. 461,254, Jan. 26, 1983, abandoned, and a continuation-in-part of Ser. No. 378,520, May 17, 1982, Pat. No. 4,520,963.

[30] Foreign Application Priority Data

Jun. 4, 1981 [DE] Fed. Rep. of Germany ..... 3122266
Jan. 27, 1982 [DE] Fed. Rep. of Germany ..... 3202618

[51] Int. Cl.[4] ..... B02C 19/00; B02C 18/00

[52] U.S. Cl. ..... 241/30; 241/228; 241/259

[58] Field of Search ..... 241/30

[56] References Cited

U.S. PATENT DOCUMENTS

| | | | |
|---|---|---|---|
| 868,656 | 10/1907 | Gramelspacher | 83/926 H |
| 1,670,171 | 5/1928 | Stevens | 82/82 |
| 2,278,459 | 4/1942 | McCashen | 241/228 X |
| 2,923,194 | 2/1960 | Ambler et al. | 83/926 H |
| 3,165,018 | 1/1965 | Brand | 83/552 X |
| 3,228,442 | 1/1966 | Borsuk | 241/259 |
| 3,427,690 | 2/1969 | Haug | 241/251 X |

FOREIGN PATENT DOCUMENTS

| | | | |
|---|---|---|---|
| 179712 | 5/1922 | United Kingdom | 82/82 |

*Primary Examiner*—Howard N. Goldberg
*Assistant Examiner*—Timothy V. Eley
*Attorney, Agent, or Firm*—Charles Hieken

[57] ABSTRACT

A process and an equipment for cutting material comprehends the surrounding at least of one, however preferably of several round knives along the inner wall of a drum. The adjacent round knives have a predetermined uniform axial distance as well as angular distance referred to the axle of the drum, at which it concerns a rotating hollow cylinder.

14 Claims, 8 Drawing Figures

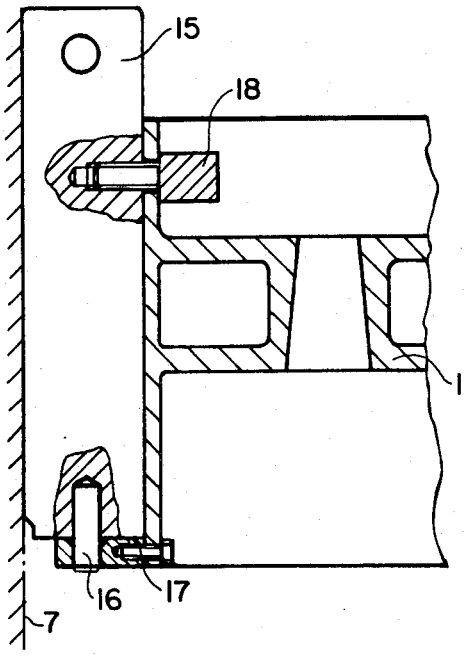
FIG. 6
FIG. 7
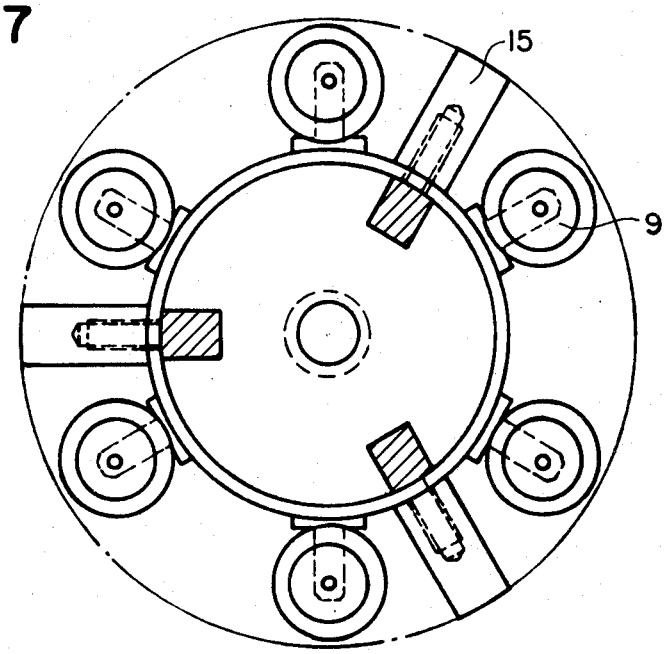

PROCESS AND EQUIPMENT FOR CUTTING MATERIAL

This is a continuation-in-part of application Ser. No. 378,520 filed May 17, 1982, now U.S. Pat. No. 4,520,963, portions of which are reproduced herein as background of the present invention, and a continuation of application Ser. No. 461,254 filed Jan. 26, 1983, now abandoned.

The invention concerns a process as well as an equipment for cutting material on the inner wall of a drum.

Such processes and equipment are used for instance in the meat processing industry. It is of importance to obtain an exact fine cutting for an excellent bond among water, fat and protein by selecting the shape of the knife edges and maintaining their distance from the inner side of the drum wall as low as possible.

This result can be obtained of course by the usual cutter knives of cutters which are used in the meat industry, but they have many great disadvantages.

Due to the fact that the material to be cut is often a relatively thin layer on the inner side of the drum wall, a small sector of the knife edge is utilized only. When this sector of the knife edge is blunt, the knife must be changed and reground. This process takes much time, work and costs, as it can be carried out on special machines only, because of the individual knife shapes.

Another disadvantage is that a relative heavy knife assembly results from the required total number of knives with appropriate rings. Its exact dynamic balancing is difficult, especially after grinding of knives.

Another disadvantage is the long projecting knife shaft of the cutting machine, which is necessary for the knife assembly. When running at high speed, slightest unbalances of the knife assembly cause dynamic vibration of knife shaft and bearing.

Considering this stage of technology, the development must create a process and an equipment of the kind as mentioned above, with removal of the stated disadvantages, especially allowing the whole cutting edge to be full utilizable, simplifying regrinding of the knives and removing or reducing problems of balancing for the fast rotating knives.

This problem is solved according to the invention with round or circular knives guided on an arc of a circle around the drum axis along the drum inner wall. The circular knives are preferably nonrotating about their respective centers and can be angularly displaced around their respective centers after wear and tear of the cutting edge in the cutting sector adjacent the drum wall, so that about six cutting positions result and the whole circumference of each round knife can be used for cutting.

Problems of balancing don't or hardly occur because angularly displacing the round knives around their respective centers to a new unused cutting area does not introduce unbalance.

When the entire circumferential edges of the round knives is completely utilized following angular displacement through a complete revolution, the round knives can be easily replaced. Moreover, the round knives can be easily reground because of the circular form and the small size.

Moreover, the small thickness of the round knives and the flow-favourable shape of the part of round knife dipping in the material to be cut, are of great advantage. The friction produced by the round knives in the material to be cut, which effects the quality of processed material, is very low.

The so-called drawing cut, desired by the meat processing industry, results from the relatively large ratio of the inside diameter of the drum to the diameter of the round knives.

A number of round knives are preferably used, which are guided along the drum inner wall in predetermined axial distance and angular distance, referred to the drum axis. The bearing is exposed to relatively insignificant strains because of the rotationally symmetric arrangement.

The round knives are preferably the same size, which is of special advantage for mounting, knife storage and for the regrinding process.

It has proved to be a special advantage when adjacent round knives are separated by a distance of about 10 to 20 mm, preferably 15 mm, and an angular distance, referred to the drum axis of 30° to 90°, preferably 60°.

According to a preferred form of the invention, the drum is a rotating hollow cylinder with the material to be cut held on its inner surface by the centrifugal force of the rotating hollow cylinder. The material to be cut of a layer thickness of about 5 to 15 mm is guided in axial direction along the inner wall of the hollow cylinder. A continuous cutting of material results in this way, compared with the usual known cutters, where only a discontinuous cutting of material is possible.

To utilize the whole circumference of the rounded knives as cutting edges, they are preferably mounted rotatably, but in different fixed angular positions. In a specific form the round knives are provided with holes uniformly displaced on a circle concentric with their respective centers for accommodating an indexing pin fixed on the respective knife holder. The holes are preferably numbered consecutively.

Moreover, it has proved to be of practical advantage that at least three removable protective strips be mounted on the tube-shaped cylinder basic body within a circle somewhat larger than the circle inducing the outermost edges of the round knives. These strips prevent round knives from contacting the inside wall of the drum and damaging the cutting edges. Prior to starting the cutting machine, the protective strips are removed. The strips are replaced on removing the knife head from the knife shaft of the cutting machine.

Other advantages, details and important features of the invention result from the following description of different examples of execution of the invention with reference to the enclosed drawing in which:

FIG. 6 is a longitudinal section through the knife holder with placed protective strip;

Figure 8:
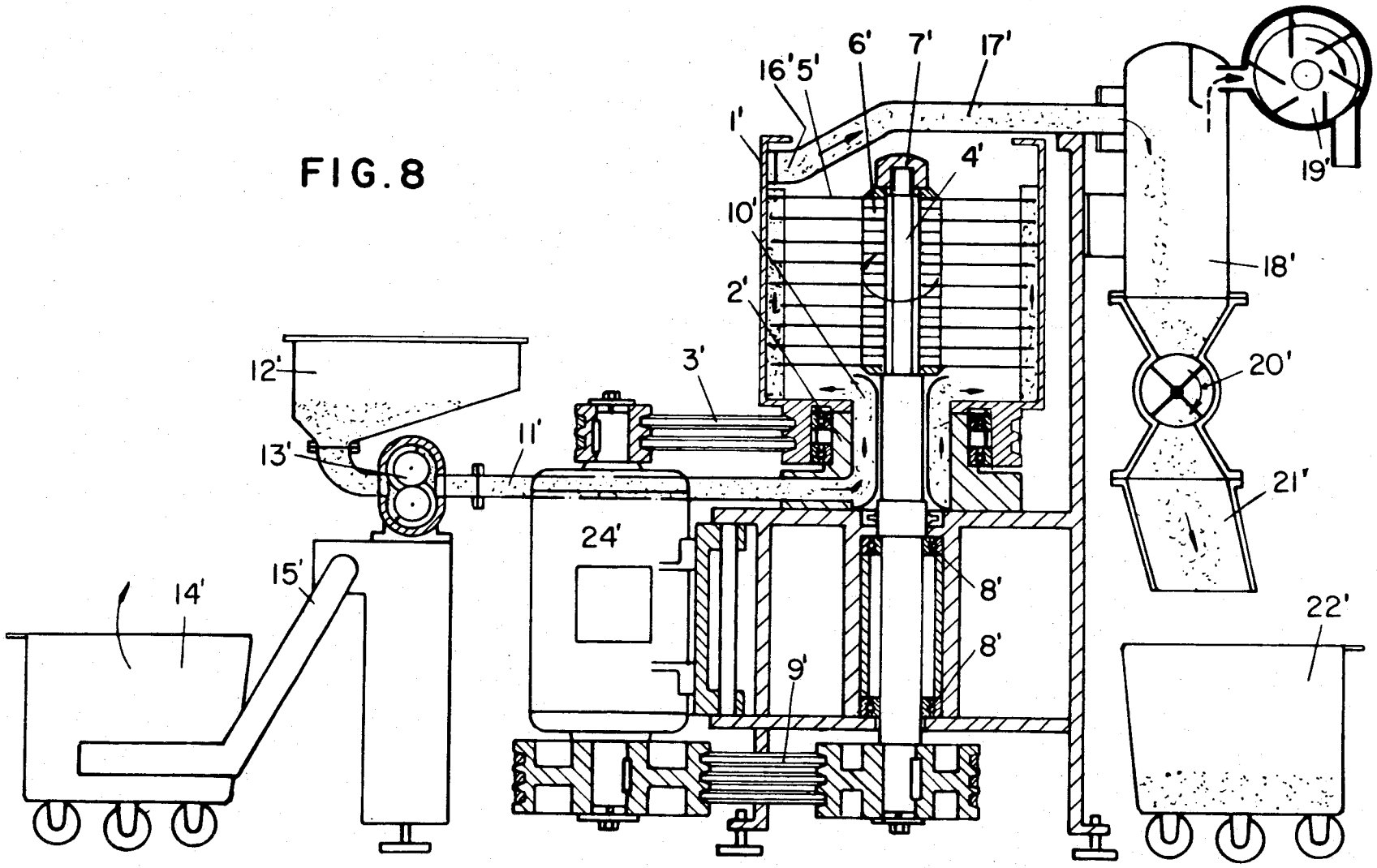

FIG. 7 is a top view on the general arrangement of the knives with placed protective strips, according to the example of execution shown in FIG. 6; and FIG. 8 is a side view of a diagrammatic representation, partially in section, of a system in which the invention is used described in the aforesaid U.S. Pat. No. 4,520,963.

With reference now to the drawings and more particularly FIGS. 1–4 thereof, the basic body of the knife head is executed as tube-shaped cylinder 1 with the knife head hub inside concentrically arranged about axle 2 of drum 19, at which the knife head hub is executed as a conical hub.

Figure 1:
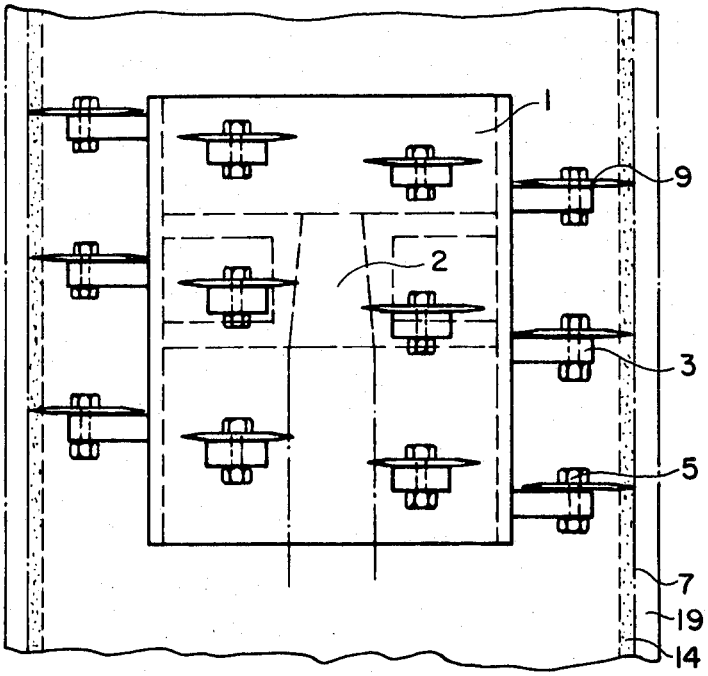
FIG. 1 is a view of the equipment of the invention at which the drum wall is cut open in the center to show the arrangement of the knives.
Figure 2:
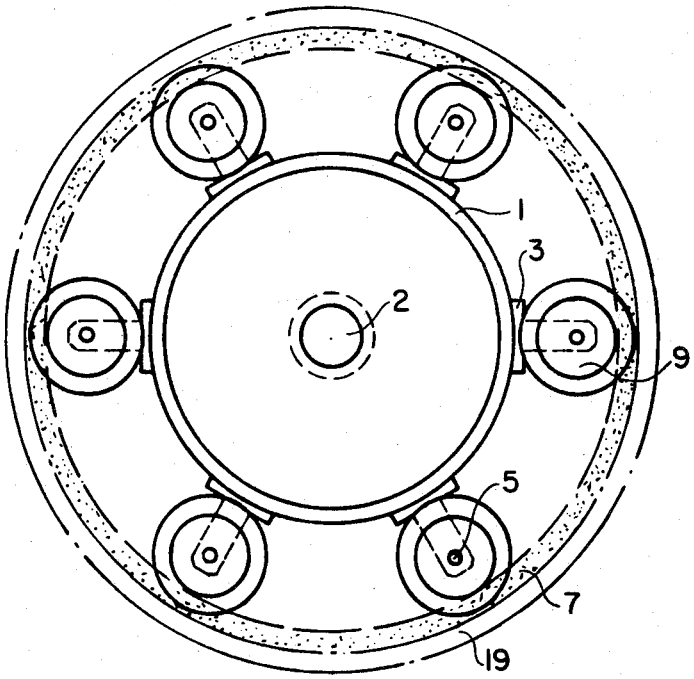
FIG. 2 is a top view on the equipment according to FIG. 1.
Figure 3:
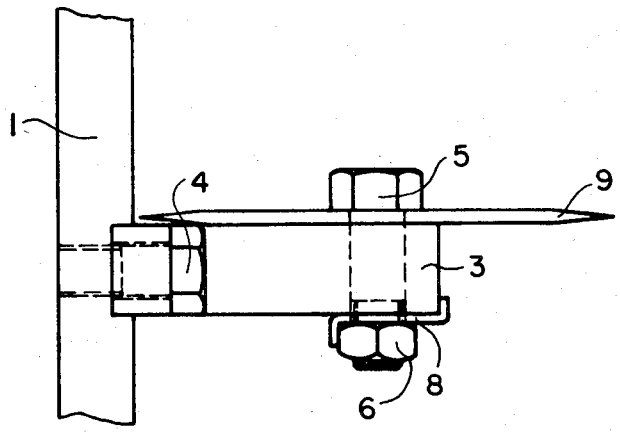
FIG. 3 is a view of a single knife holder with round knife.

Knife holders 3 are mounted on millings in the outer circumferential surface of basic body 1 by means of hexagonal head bolts 4, and as shown in FIG. 2, angularly displaced about the drum axis from an adjacent holder by 60°. As shown in FIG. 1 the knife holders 3 are uniformly spaced from adjacent holders in longitudinal or axial direction of the basis body to form a spiral arrangement of knife holders 3 around the basic body 1. An axial distance between adjacent knives of about 15 mm has proved useful.

Round or circular knives 9 are fixed to respective knife holders 3 with shoulder screws 5 with hexagon nuts 6 locked by means of locking plates 8 against loosening.

Figure 4:
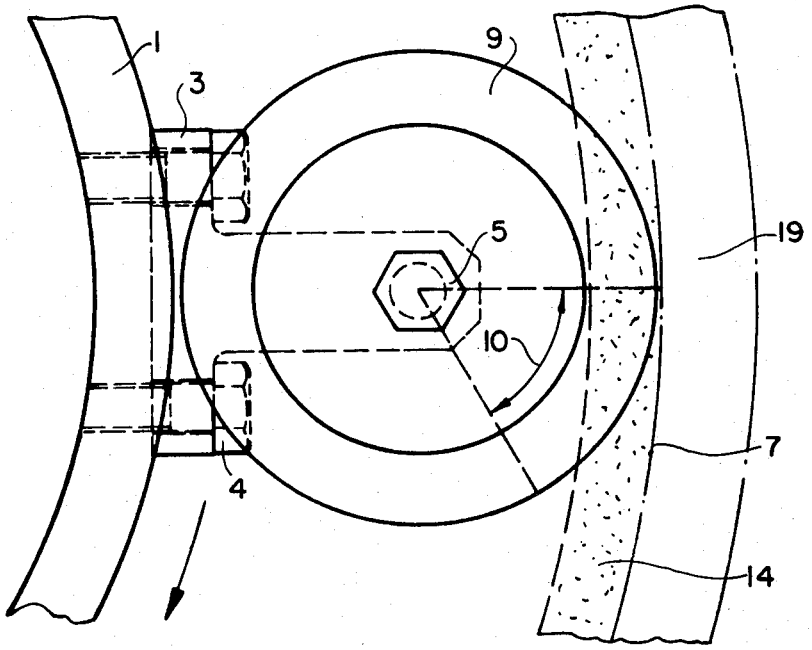
FIG. 4 is a top view of the knife holder according to FIG. 3.

As shown in FIG. 4 the cutting edges of round knives 9 are in the area of the outer wrapping circle 7 only around all round knives in the material to be cut 14. A cutting sector 19 of the single round knife which has only about a sixth of the whole circumference of the cutting edge results from the direction of rotation marked by an arrow in FIG. 4.

Figure 5:
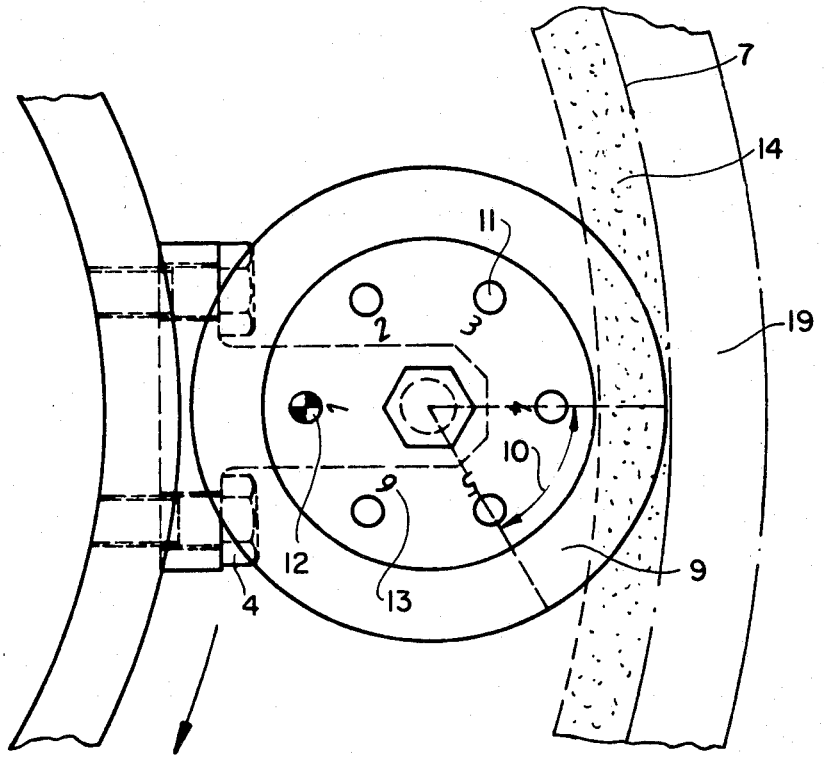
FIG. 5 is a presentation corresponding to FIG. 4 of another kind of execution of the invention.

FIG. 5 shows another example of execution of knife holders 3 and of round knives 9. On a pitch circle around the center of round knives 9, they have six holes 11 equiangularly spaced about the center. These holes are preferably provided with imprinted of engraved consecutive numbers 13. Indexing pins 12 are fixed to the knife holders 3, so that at a certain one, for instance on the cutting sector 10, as drawn, indexing pin 12 is in hole No. 1. The round knife can be angularly displaced around its center after loosening shoulder screw 5, so that now another hole, like perhaps hole 11 No. 3 receives indexing pin 12 and consequently a new keen cutting sector 10 comes into position for cutting material 14.

FIG. 6 and 7 shown an example of execution of the knife head, at which three protective strips 15 are fixed to the outside of the basic body 1 by means of steel pins 16 and knurled screws 18 for which basic body 1 has holding blocks with holes such as 17 and thru holes in the area of the knurled screws 18. A simple and quick mounting and removal of protective strips 15 thereby results. The radial height of strips 15 is so executed that an outer wrapping circle corresponds to the drum inside diameter, and is therefore somewhat larger than the outer wrapping circle 7 (FIGS. 4 and 5) around the round knives 9, as shown in FIG. 7.

In the description which follows axle 2 corresponds to knife shaft 4' to which is secured tube-shaped cylinder 1.

FIG. 8 is a side view of a diagrammatic representation, partially in section, of a system in which the invention is used described in the aforesaid parent application.

Having considered specific structure according to the present invention shown in FIGS. 1–7, it is helpful to consider the system in which the invention is used described in the aforesaid patent application shown in FIG. 8, corresponding to FIG. 1 of the aforesaid parent application.

Referring to FIG. 8, a generally cylindrically shaped vessel 1' is rotatably mounted on a machine frame by a bearing 2'. The vessel can also be shaped conically. The drive is effected by a driving motor 24' via a V-belt drive 3'.

In this embodiment the rotary axis of the vessel 1' is vertical. Coaxial to the axis of vessel 1' is a knife shaft 4' rotatably mounted on a bearing 8', opposite to the machine frame. The drive of the knife shaft 4' is effected by the driving motor 24' provided with two shaft ends, via a further V-belt drive 9'.

Coaxial to the knife shaft 4' in the area of the inlet opening of the vessel 1', there is mounted a feeding channel 10' for the material to be cut, which is generally shaped like a hollow cylinder. A feeding tube 11', which is connected to a pump for thick material 13', communicates with feeding channel 10'. Pump 13' is installed ahead of filling hopper 12'.

On knife shaft 4' that is polygonally shaped in cross section in the area of the vessel 1', knives 5' are mounted which can be provided with several cutting edges and a polygonal accepting bore 28' in the center. Between adjacent knives 5', there are intermediate disks 6'. A tension nut 7' keeps the knives on shaft 4'.

At the discharge end of vessel 1', a peeling head 16' extends into the vessel 1' close to the inside of the terminal wall. A discharging tube 17' is attached to peeling head 16'. In order to easily withdraw upward the cut material from the unit, the discharging tube 17' extends into vacuum tank 18'. A vacuum pump 19' produces vacuum in the tank 18'. A bucket wheel sluice 20' discharges the material from vacuum tank 18'. A discharging tube 21' is attached to wheel sluice 20'.

Operation of this system is as follows:

The material to be cut is transported by trolley 14' to the charging end of the equipment. The material is tilted into the hopper 12' by means of a lifting and tilting device 15'. The uniform feeding of material to be cut into the vessel 1' is carried out by pump for thick material 13', feeding tube 11' and feeding channel 10'.

Because of the rotation of vessel 1' along its longitudinal axis, a layer of a material of uniform thickness builds up on the inside of the wall of vessel 1'. The thickness of the layer depends, among other factors, on the feeding speed by pump 13'. The knives 5' rotating with a considerably higher speed in the same direction of rotation, divide the layer of material on the inside of the vessel 1' by a drawing cut.

In consequence of the rotation of the vessel 1' and thereby the centrifual force acting on the material to be cut on the one side, and the feeding of material by means of pump 13' on the other side, the material is transported along the inside wall of the vessel 1' in axial direction to the discharging end. At the discharging end of the vessel 1' the peeling head 16' comes from the open end of the vessel 1' near to the inside wall of the vessel to loosen the material. Because of the vacuum produced in the tank 18' by the vacuum pump 19', the material is drawn off from the vessel 1' through the discharging tube 17'. The cut material accumulating on the bottom of the tank 18' is set free by maintaining the vacuum inside the tank 18' by means of bucket wheel sluice 10' and fed through discharging tube 21' to a trolley 22' for carrying away.

The present invention refers as an example only to a cutting equipment as used in the meat processing industry. However, the equipment of the invention can be employed also for cutting other material. It is evident that those skilled in the art may now make numerous uses and modifications of and departures from the specific apparatus and techniques disclosed herein. Consequently, the invention is to be construed as embracing each and every novel feature and novel combination of features present in or possessed by the apparatus and techniques herein disclosed and limited by the spirit and scope of the appended claims.

What is claimed is:

1. Process for cutting material on the inner wall of a drum, including the steps of guiding round knives each having a center of rotation on an arc of a circle around the drum axis along the drum inner wall while maintaining and round knives, nonrotating about their respective centers of rotation, continuously feeding material into said drum while rotating said drum around said axis with sufficient speed so that the fed material is guided to and positioned against the inside of the drum all by the centrifugal force and cut by said round knives while positioned against the inside of the drum wall, and continuously withdrawing the cut material from the drum thus rotating.

2. Process according to claim 1 and further including angularly displacing said round knives about their respective axes to expose a different cutting portion of said round knives as said knives move along said arc.

3. Process according to claim 1 and further including rotating said round knives and said drum about the drum axis in the same direction.

4. Process according to claim 1, and further including rotating said round knives and said drum about the drum axis in opposite directions.

5. Apparatus for cutting material on the inner wall of a drum and wherein round knives are guided on an arc of a circle around the drum axis along the drum inner wall while maintaining the round knives nonrotating about their respective centers of rotation comprising, said drum having said inner wall, said round knives, axle means for mounting said round knives stationary about their centers of rotation, means for rotatably mounting said round knives held stationary on said axle means angularly spaced around the drum axis guidable along said inner wall, means for rotating said drum around said drum axis with sufficient speed to position said material against the inside of said drum wall, means for continuously feeding said material into said drum while said drum is rotating with sufficient speed to position said material against the inside of the drum wall, means for rotating the assembly of said round knives about the drum axis along the inside of the drum wall to cut said material while said drum is rotating with sufficient speed to position said material against the inside of the drum wall, and means for continuously withdrawing the cut material from said drum while said drum is rotating with sufficient speed to position said material against the inside of the drum wall.

6. Apparatus according to claim 5 and further comprising, a plurality of said round knives, and means for rotatably mounting said round knives angularly spaced around the drum axis guidable along said inner wall.

7. Apparatus according to claim 6 and further comprising, means for supporting said round knives equiangularly about the drum axis.

8. Apparatus according to claim 6 wherein the radial distance between each round knife and said inner wall relative to that of each other knife is within the range of 10 to 20 mm and the angular spacing between adjacent round knives about the drum axis is within the range 30 degrees to 90 degrees.

9. Apparatus according to claim 8 wherein said radial distance is substantially 15 mm and said angular separation is substantially 60 degrees.

10. Apparatus according to claim 6 wherein at least two of said round knives are angularly spaced about the drum axis by 180 degrees and the radial distance between one of the latter knives and said inner wall and that between the other and said inner wall differs by substantially 15 mm.

11. Apparatus according to claim 6 wherein said means for supporting said round knives comprises a tube-shaped cylinder rotatably mounted about the drum axis, and means for mounting said round knives on the outer surface of said tube-shaped cylinder.

12. Apparatus according to claim 6 and further comprising means for selectively positioning each of said round knives in a predetermined angular orientation about the round knife axis selectively, whereby each knife may be selectively angularly displaced to maintain a relatively sharp cutting edge adjacent to said inner wall.

13. Apparatus according to claim 12 wherein said means for selectively positioning comprises a plurality of openings angularly displaced about the knife axis and an indexing pin for engagement with a respective one of said openings.

14. Apparatus for cutting material on the inner wall of a drum and wherein when operating said apparatus round knives are guided on an arc of a circle around the drum axis along the drum inner wall while maintaining the round knives nonrotating about their respective centers of rotation comprising, said drum having said inner wall, said round knives, axle means for mounting said round knives stationary about their centers of rotation, means for rotatably mounting said round knives held stationary on said axle means angularly spaced around the drum axis guidable along said inner wall, means for continuously feeding material into said drum when operating while rotating said drum around the drum axis with sufficient speed so that the fed material is guided to and positioned against the inside of the vessel wall by the centrifugal force and cut by the round knives when operating while positioned against the inside of the drum wall, means for continuously withdrawing the cut material from the drum when operating and thus rotating, and a plurality of removable protective strips mounted for protecting said round knives when being mounted and demounted with said apparatus not operating.

* * * * *